US007584690B2

(12) United States Patent
Cauley

(10) Patent No.: US 7,584,690 B2
(45) Date of Patent: Sep. 8, 2009

(54) FIREARM VISE

(75) Inventor: Dennis Cauley, Boonville, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 345 days.

(21) Appl. No.: 11/271,100

(22) Filed: Nov. 10, 2005

(65) Prior Publication Data

US 2006/0218840 A1 Oct. 5, 2006
US 2007/0074440 A2 Apr. 5, 2007

Related U.S. Application Data

(60) Provisional application No. 60/626,689, filed on Nov. 10, 2004.

(51) Int. Cl.
*F41A 23/16* (2006.01)

(52) U.S. Cl. ..... 89/37.04; 42/94

(58) Field of Classification Search ..... 89/37.04; 42/94; 73/167
See application file for complete search history.

(56) References Cited

U.S. PATENT DOCUMENTS 499,315 A * 6/1893 Borchardt ..... 89/132
568,543 A * 9/1896 Parks ..... 269/45
1,089,307 A 3/1914 Benet et al.
1,367,353 A 2/1921 Craig
2,378,545 A * 6/1945 Fraser et al. ..... 73/167
4,012,860 A 3/1977 Auger
4,333,385 A 6/1982 Culver
4,438,913 A * 3/1984 Hylla ..... 269/60
4,548,392 A 10/1985 Rickling
4,621,563 A 11/1986 Poiencot
4,799,324 A 1/1989 Nodo
4,841,839 A 6/1989 Stuart
4,873,777 A 10/1989 Southard
D310,302 S 9/1990 Southard
4,971,208 A 11/1990 Reinfried, Jr. et al.
D313,886 S 1/1991 Southard
4,998,944 A 3/1991 Lund
5,058,302 A 10/1991 Minneman
5,070,636 A * 12/1991 Mueller ..... 42/94
5,081,783 A 1/1992 Jarvis
5,375,337 A 12/1994 Butler
5,414,949 A 5/1995 Peebles
D364,080 S 11/1995 Weyrauch
5,628,135 A 5/1997 Cady
5,661,919 A * 9/1997 Pryor ..... 42/94

(Continued)

OTHER PUBLICATIONS

U.S. Appl. No. 10/865,595, filed Jan. 6, 2005, Cauley et al.

(Continued)

*Primary Examiner*—Stephen M Johnson
(74) *Attorney, Agent, or Firm*—Perkins Coie LLP

(57) ABSTRACT

A firearm holding device for holding a firearm having a forend, a grip and a buttstock. The holding device comprises a base having a longitudinal axis, a forend support mounted on the base for supporting the forend of the firearm, a grip support mounted on the base for supporting the grip of the firearm, and a buttstock support mounted on the base for supporting the buttstock of the firearm. At least one of the forend support, grip support and buttstock support are moveable on the base along the longitudinal axis of the base to accommodate various sizes and types of firearms.

20 Claims, 14 Drawing Sheets

U.S. PATENT DOCUMENTS

| | | | |
|---|---|---|---|
| D391,616 | S | 3/1998 | Plybon |
| 5,758,447 | A | 6/1998 | Venetz |
| 5,811,720 | A | 9/1998 | Quinnell et al. |
| 6,044,747 | A | 4/2000 | Felts |
| 6,293,041 | B2 | 9/2001 | Weaver |
| D471,248 | S | 3/2003 | Jacobs |
| D513,055 | S | 12/2005 | Lahti |

OTHER PUBLICATIONS

U.S. Appl. No. 11/431,956, Morrow et al.

"Cleaning Cradles: Sinclaire Cleaning Cradles" p. 21. 1 page. The date on which the Sinclair Folding Cleaning Cradle was first on sale is not known, but is believed to be circa 2004.

Midway USA. "Tipton Range Box with Ultimate Rifle, Handgun Cleaning Kit (No Solvents)". <URL: http://www.midwayusa.com/rewriteaproduct/135086>. 2 pages. The date on which the Tipton Range Box was first on sale is not known, but is believed to be circa 2004.

MTM Case-Guard. "Gun Maintenance Centers." 2 pages. The date on which the MTM Gun Maintenance Center was first on sale is not known, but is believed to be circa 2004.

MTM Case-Guard. "Rifle rest and pistol shooting rest". <URL: http://www.mtmcase-gard.com/products/shooting/shoo.html>. 3 pages. The date on which the MTM Site-In-Clean was first on sale is not known, but is believed to be circa 2004.

The Sportsman's Guide. "Plano Shooters Case!" <URL: http://www.sportsmansguide.com/cb/cb.asp?a=148225>. 3 pages. The date on which the Plano Shooters Case was first on sale is not known, but is believed to be circa 2004.

Four photos of the Lohman Sight Vise. The date on which the Lohman Sight Vise was first on sale is not known, but is believed to be circa 2004.

"Decker Rifle Vise". 1 page. The date on which the Decker Rifle Vise was first on sale is not known, but is believed to be circa 2004.

1Shop2.com. "Hoppe's Gunsmith's Fully Adjustable Bench Vise" 3 pages. The date on which The Hoppe's Gunsmith's Fully Adjustable Bench Vise was first on sale is not known, but is believed to be circa 2004.

Cabela's: World's Foremost Outfitter. "HySkore Sighting System and Cleaning Vise". 1 page.The date on which the HySkore Sighting System and Cleaning Vise was first on sale is not known, but is believed to be circa Jan. 2005. However, a prototype of this product may have been shown to buyers at Cabela's circa Aug. 2004.

Cabela's. "Master Catalog Fall 2003: Late-Season Edition". Cover page and p. 416. 2 pages.

Brownells. Catalog No. 57. For 2004-2005. 2 pages.

Cabela's Hunting Fishing and Outdoor Gear Master Catalog, Fall 2002, Edition II, Minimizer Rifle Rest, Items No. SC-22-4332 and SC-22-4333, p. 492.

Battenfeld Technologies, Inc., "Steady Rest Portable Shooting Rest," file://C:\DOCUME~1\DUTCD\LOCALS~1\Temp\PQ28V28J.htm, 1 page, accessed Jan. 25, 2006.

Lahti Company, Evaluator Brochure, http://www.lathicompany.com/Forms/EvaluatorBrochure2.jpg, 2 pages, accessed Jan. 16, 2006.

Ellett Brothers, Rests & Gun Vises, 3 pages. no date provided.

AcuSport, Outdoor Sporting Products, 3 pages. no date provided.

Californiavarmintcallers.com-forum, http://californiavarmintcallers.com/community/modules/newbb/viewtopic.php?topic_id=10&foru m=9&PHPSESSID=074ed8c7 . . . , pp. 1-4, accessed Jan. 16, 2006.

"American Rifleman: What to do about recoil," LookSmart, http://www.findarticles.com/p/articles/mi_qa3623/is_199907/ai_n8861959/print, pp. 1-4, accessed Jan. 4, 2006.

Tenex Precision Co., "Recoil A-Rest-R," Product Pictures, 4 sheets, Riverside, CA. no date provided.

MTM Shoulder-Gard Rifle Rest, MTM Case-Gard, p. 2 "Rests" no date provided.

* cited by examiner

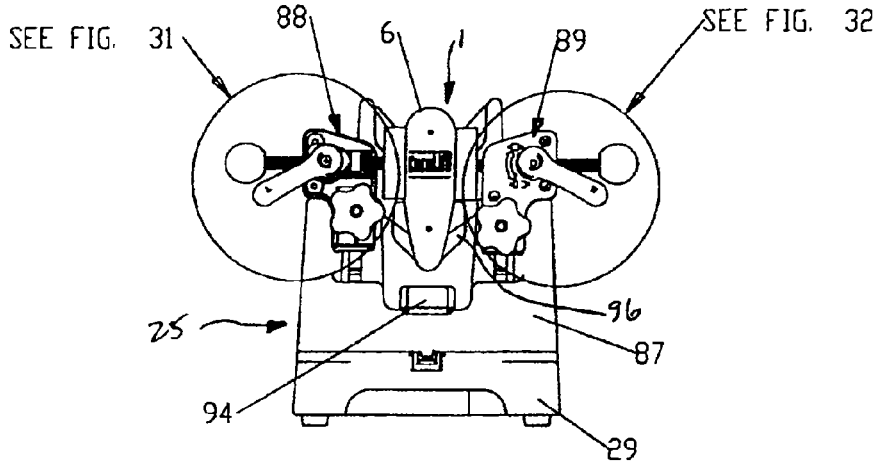
FIG. 30
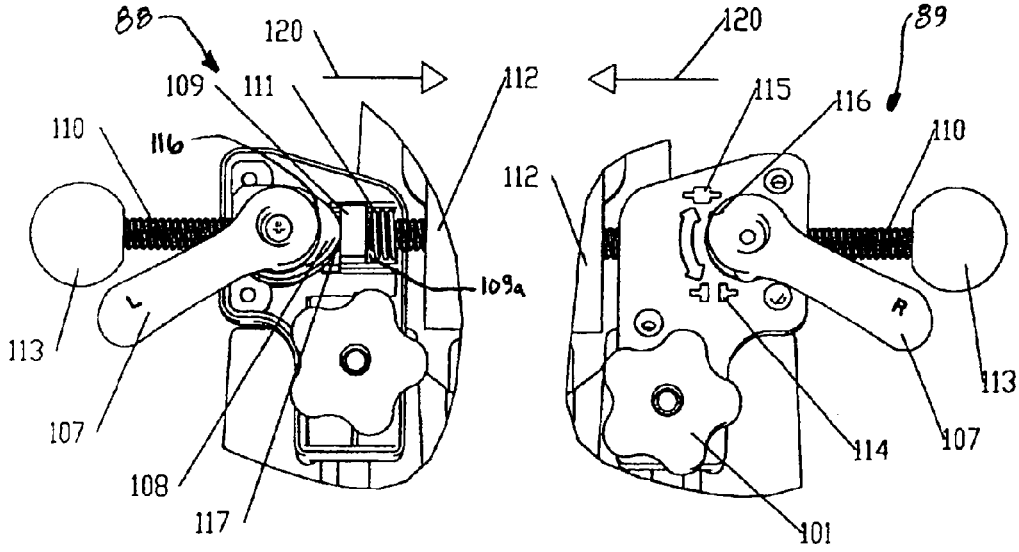
FIG. 31
FIG. 32

FIREARM VISE

CROSS-REFERENCE TO RELATED APPLICATION(S)

This application is a non-provisional of U.S. Provisional Patent Application Ser. No. 60/626,689, filed Nov. 10, 2004, which is incorporated herein by reference.

BACKGROUND OF THE INVENTION

This invention relates generally to a firearm holding device and more particularly to a device for securely holding a rifle or shotgun for cleaning, maintenance, minor repairs, or mechanical modification.

This invention allows both hands of the user to work with the firearm, as the invention alone will hold and support the firearm in a stable, secure position. In addition, the adjustable features of the various components of the invention enable the user to position virtually any type of rifle or shotgun securely in an optimal position.

Traditionally, a firearm such as a rifle or shotgun is either handheld during cleaning and maintenance or a standard metal machinist vise or shop vise is used to hold the firearm for cleaning or maintenance. While a shop vise can be used to secure a rifle or shotgun and is definitely more secure than holding the firearm with one hand, it has many potentially negative features. A standard metal vise has metal jaws or clamping surfaces that must be covered with a softer material to avoid damage to the metal or stock of a firearm. The jaw coverings frequently fall from the vise after installation or are not installed resulting in damage to the firearm from the metal jaws.

A traditional vise can be used to support a firearm by positioning the jaws of the vise so as to clamp the firearm at one point along the length of the firearm. A traditional vise does not hold and support a rifle or shotgun at points on both the forend and butt stock simultaneously. Since a standard vise must clamp on to the firearm at only one point, the pressure at this point to effectively hold and secure the firearm must often be so great that the stock or mechanism of the firearm can be damaged.

A standard vise has no compartments for holding cleaning supplies or other items used during normal maintenance, repair or modification of rifles or shotguns. Also, most vises sturdy enough to hold a rifle or shotgun are usually quite large and heavy and must be fixedly mounted and attached to a bench. Such fixedly mounted vises cannot be readily moved from one work area to another.

Therefore, there is a need for a firearm holding device that will hold and support a rifle or shotgun securely and without damage to the firearm. In addition, such a firearm holding device should support the firearm on or at two or more separate points along the longitudinal length of the firearm and it should provide for optimal positioning of many different designs of firearms for the task at hand. Also, there is a need for a firearm holding device that is lightweight and portable and that provides storage areas for holding maintenance and repair supplies.

SUMMARY OF THE INVENTION

A firearm holding device of the present invention preferably provides at least two points of support along the longitudinal length of the firearm and allows a user to properly secure virtually any type or design of rifle or shotgun. In one embodiment, the firearm holding device uses non-marring synthetic materials to eliminate the possibility of damage to the stock or the mechanism of the firearm. The amount of clamping pressure applied by such holding device to the firearm can be adjusted and limited. The horizontal position of the firearm held in the firearm holding device can be regulated by the use of the various adjustable support components, preferably at the front, middle and rear of the firearm. A firearm holding device of the present invention can be permanently attached to a bench or it can be used as a portable workstation on the flat surface of any table or bench. The firearm holding device is relatively lightweight and can be moved easily from one area to another. One embodiment of a firearm holding device of this invention also incorporates numerous built in storage areas for materials and tools used in the cleaning and maintenance of rifles and shotguns.

In general, the present invention is directed to a firearm holding device for holding a firearm having a forend, a grip and a buttstock. The holding device comprising a base having a longitudinal axis, a forend support mounted on the base for supporting the forend of the firearm, a grip support mounted on the base for supporting the grip of the firearm, and a buttstock support mounted on the base for supporting the buttstock of the firearm. At least one of the forend support, grip support and buttstock support are moveable on the base along the longitudinal axis of the base to accommodate various sizes and types of firearms.

In another aspect, the present invention is directed to a firearm holding device for holding a firearm. The holding device comprises a base for mounting the device on a flat surface, a forend support moveably mounted on the base for supporting the firearm, a grip support moveably mounted on the base for supporting the firearm, and a buttstock support moveably mounted on the base for supporting the firearm. The forend support, grip support and buttstock support being moveable on the base to accommodate various sizes and types of firearms.

BRIEF DESCRIPTION OF THE DRAWINGS

FIG. 30 is a view similar to FIG. 27 but showing the buttstock clamps in a closed position.

FIG. 31 is a detail view of a portion of FIG. 30.

FIG. 32 is a detail view of a portion of FIG. 30.

DESCRIPTION OF THE PERFERRED EMBODIMENT

Figure 1:
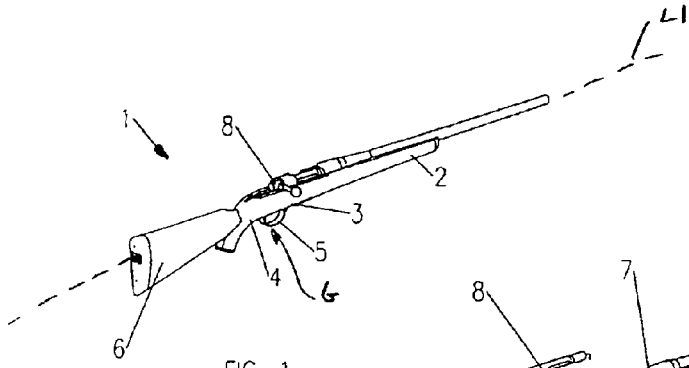
FIG. 1 is a perspective view of a typical bolt-action rifle.
Figure 2:
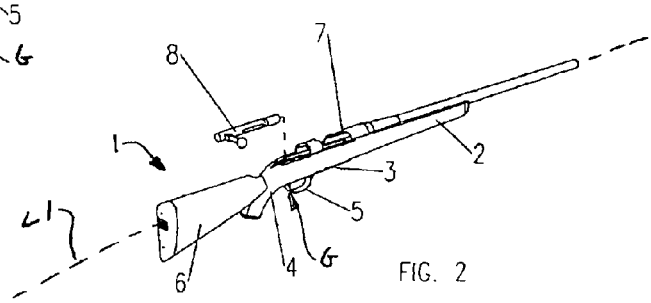
FIG. 2 is a perspective view of a typical bolt-action rifle with the bolt removed.
Figure 3:
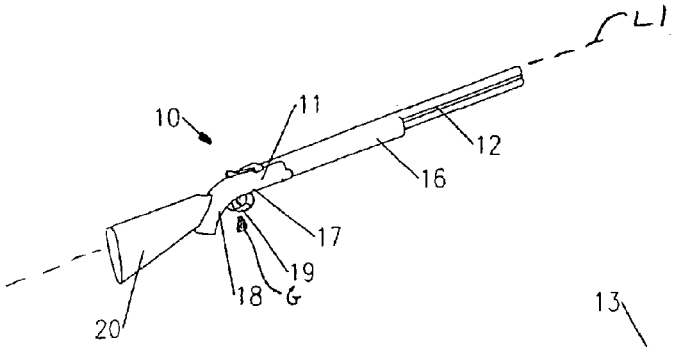
FIG. 3 is a perspective view of a typical break open, double-barreled shotgun with the action closed.
Figure 4:
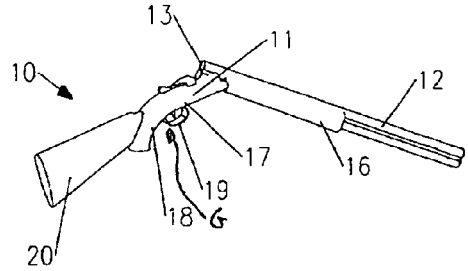
FIG. 4 is a perspective view of a typical break open double barrel shotgun with the action open.

A firearm holding device of the present invention supports and secures a firearm (e.g., rifle, shotgun, or other firearm) with multi-point support for cleaning or maintenance. Two exemplary firearms that may be supported by the firearm holding device of the present invention include a bolt-action rifle 1 (FIGS. 1 and 2) and a break open sporting shotgun 10 (FIGS. 3 and 4). A typical bolt-action rifle 1, as shown in FIG. 1, is best secured for cleaning, maintenance, or minor repairs by support on at least two of the following three surfaces spaced along the longitudinal axis L1 of the rifle: the stock forend 2; the underside of the stock at a location 3 in front of the trigger guard 5 or at a location 4 behind the trigger guard either or both of these locations 3, 4 being referred to herein as the "grip" G of the firearm; and preferably adjacent the rear of the buttstock 6. Access to the interior 7 of the rifle 1 for cleaning is typically accomplished by removal of the bolt 8 (see FIG. 2). Use of a traditional machinist, or bench vise (not shown), to clamp the rifle 1 between the jaws of the vice at any one of the above three locations (stock forend 2, underside of stock 3, grip G, or rear of buttstock 6) spaced along the longitudinal length of the rifle may result in damage to the stock or the mechanism of the rifle due to the increased holding pressure that is required to support the rifle at a single point.

As shown in FIGS. 3 and 4, a typical break open sporting shotgun 10 is hinged at the receiver 11 to provide access to the interior of the firearm. The break open shotgun 10 should be held in an open position (FIG. 4) for cleaning in which the receiver 11 is unlocked and the barrels 12 are pivoted away from the receiver 11. With the barrels 12 unlocked and opened, as in FIG. 4, the user will have access to the inside 13 of the barrels 12 for cleaning or maintenance. As with a bolt-action rifle 1, support should be placed on the following surfaces along the longitudinal length of the shotgun 10: the stock forend 16 or barrels 12; the lower surface 17 in front of the trigger guard 19 or the surface 18 behind the trigger guard either or both of these locations 17, 18 being referred to herein as the "grip" G of the firearm; and near the rear of the butt stock 20. It is understood that the mechanisms of a typical bolt-action rifle 1 and a break open shotgun 10 are quite different and require different mechanical supports for optimal security and rigidity when performing routine maintenance and cleaning.

Figure 5:
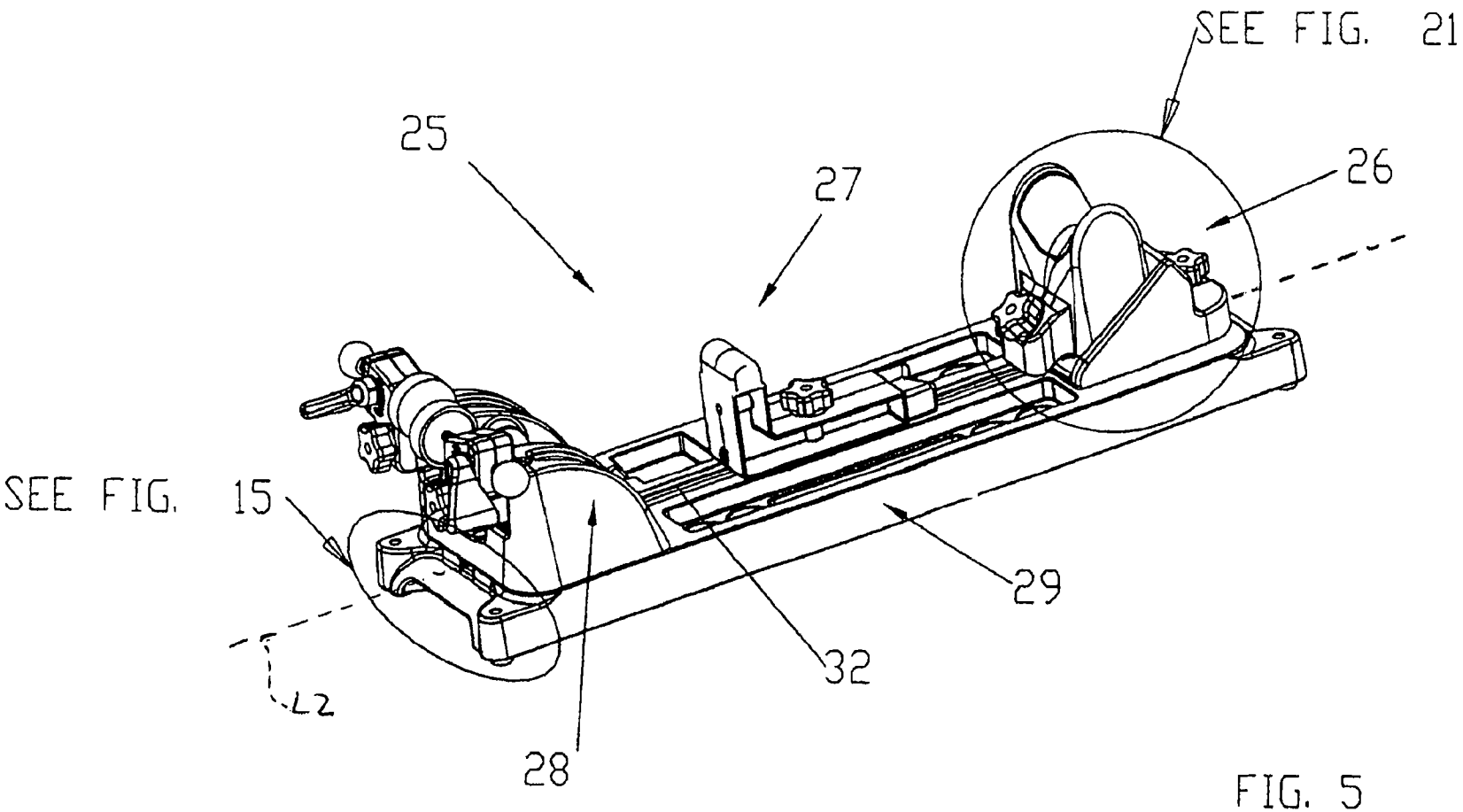
FIG. 5 is a right side perspective view of one embodiment of a firearm holding device of the present invention.
Figure 6:
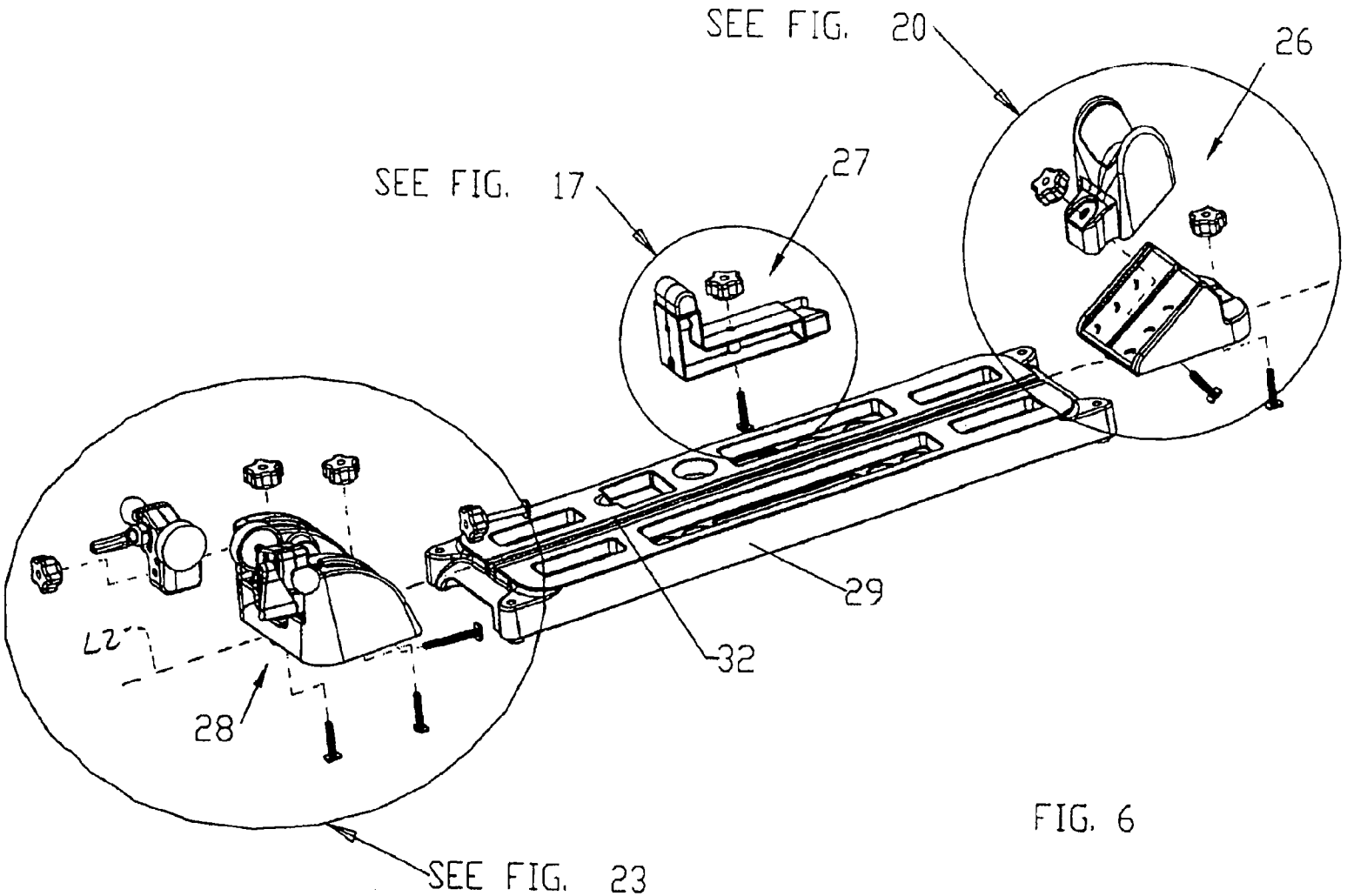
FIG. 6 is an exploded perspective view of the holding device of FIG. 5.

As shown in FIGS. 5 and 6, one embodiment of the firearm holding device (gun vise), generally indicated 25, includes four subsystems to provide the numerous positions necessary for supporting a wide range of rifles and shotguns, namely, a forend (front) support generally indicated 26, a grip (center) support generally indicated 27, a buttstock (rear) support generally indicated 28, and a base generally indicated 29 having a longitudinal axis L2 for mounting the vise on a flat surface. The forend support 26, grip support 27 and buttstock support 28 are removably attached to the base 29 and may be translated longitudinally along the base 29 to alter their positions relative to each other.

Figure 7:
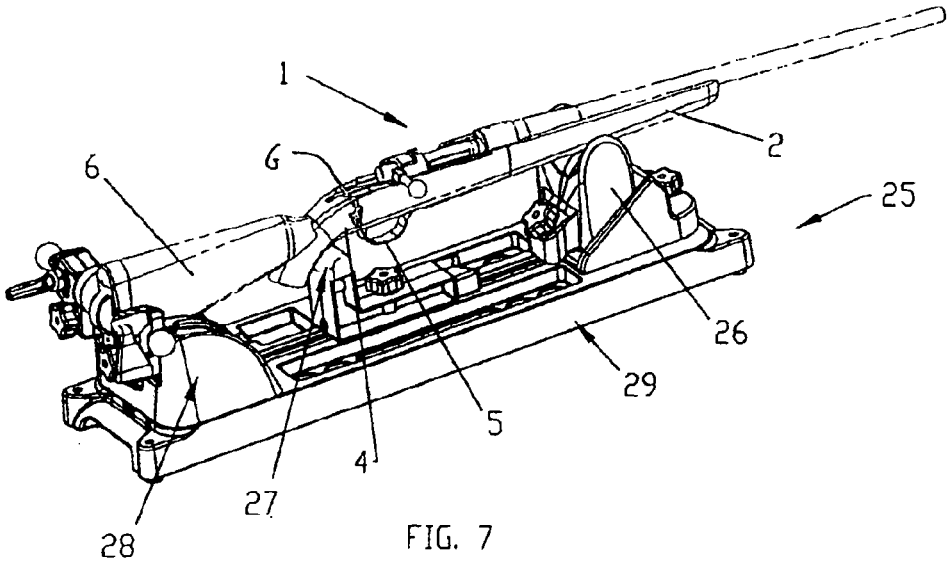
FIG. 7 is a right side perspective view of a typical bolt-action rifle secured in the firearm holding device.
Figure 8:
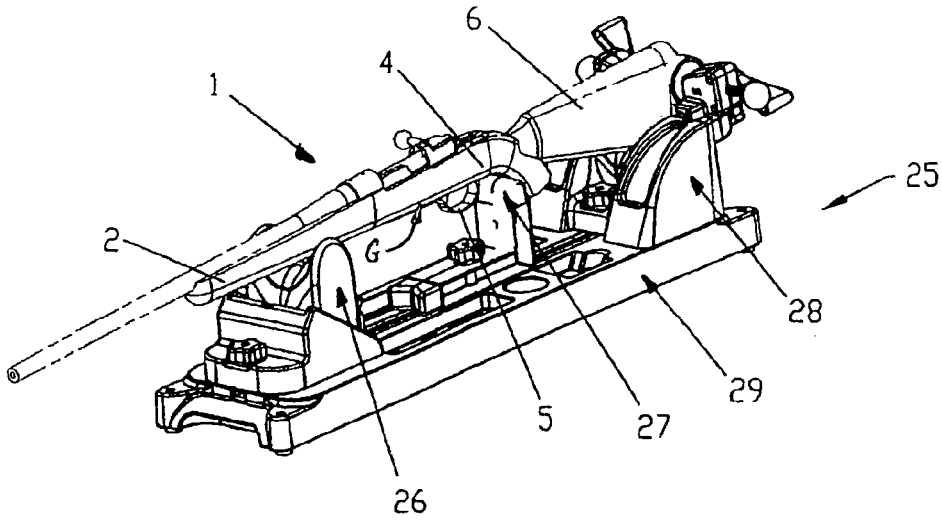
FIG. 8 is a left side perspective view of a typical bolt-action rifle secured in the holding device.
Figure 9:
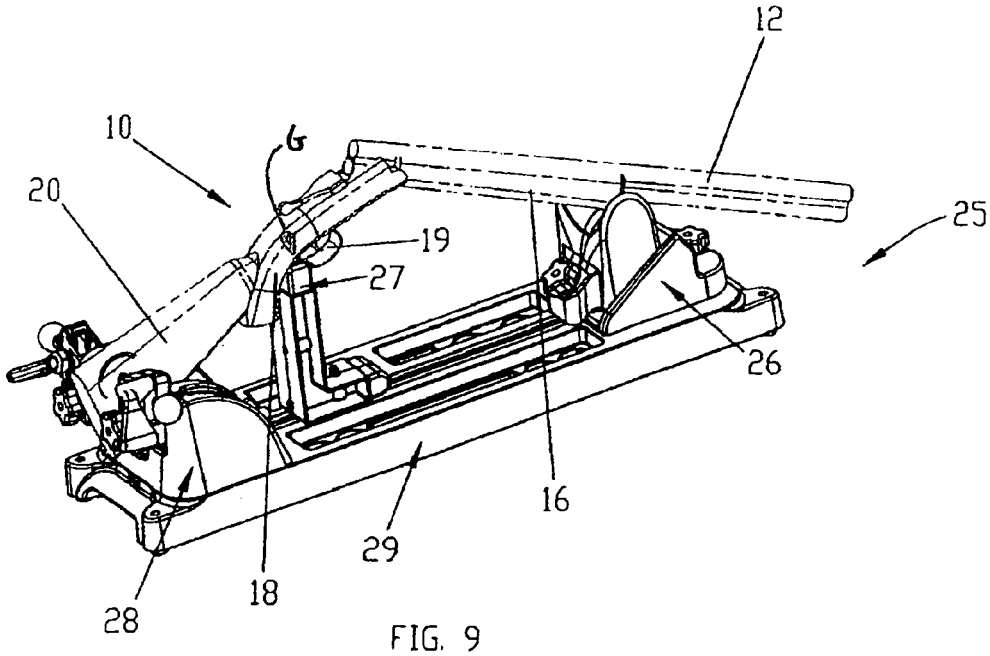
FIG. 9 is a right side perspective view of a typical break open shotgun secured in the holding device.
Figure 10:
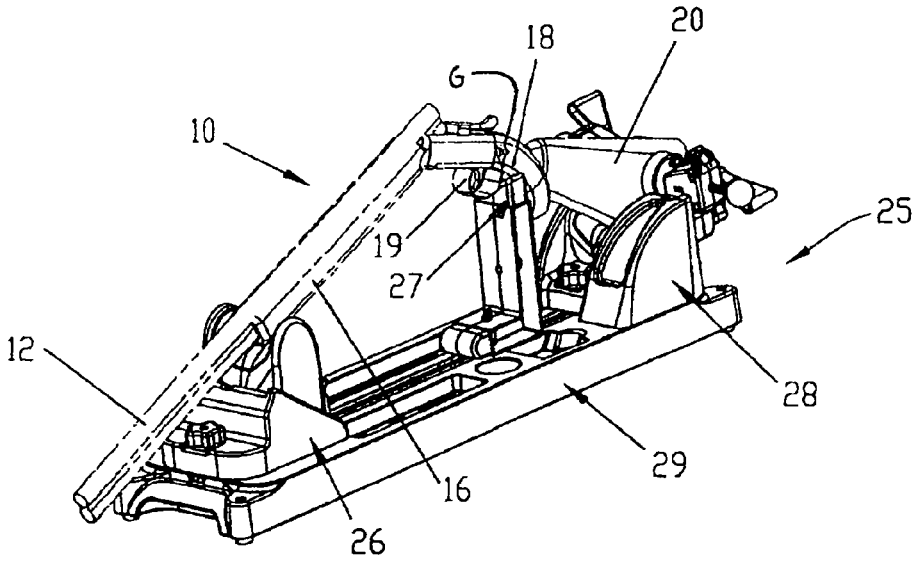
FIG. 10 is a left side perspective view of a typical break open shotgun secured in the holding device.
Figure 11:
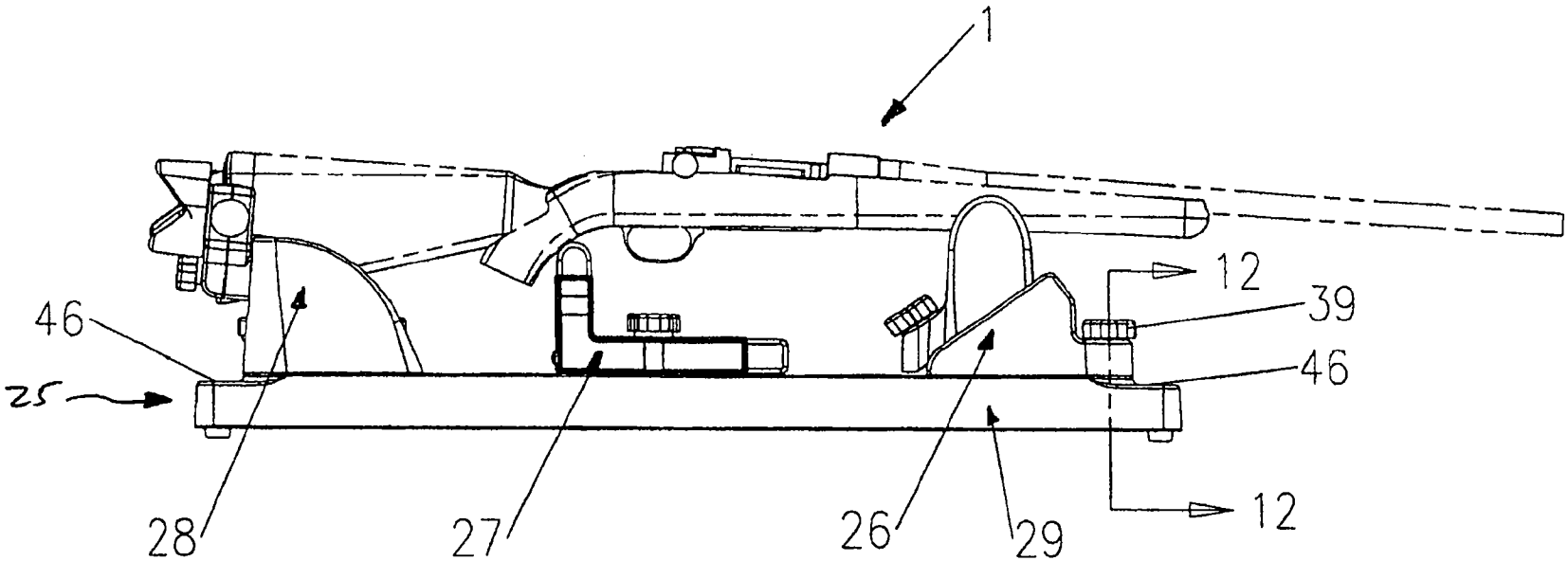
FIG. 11 is a right side elevation view of a typical bolt-action rifle secured in the holding device.

FIGS. 7-10 compare the different positions of the vise 25 that are used to secure the bolt-action rifle 1 and the break open shotgun 10 for cleaning or maintenance. As shown in FIGS. 7 and 8, the bolt-action rifle 1 is supported by contact with the vise 25 at three locations along the longitudinal length of the rifle. The forend support 26 contacts the stock forend 2 of the rifle 1, the grip support 27 contacts the rifle at the grip G on the stock behind trigger guard 5, and the buttstock support 28 contacts the rifle near the rear of the buttstock 6. As shown in FIGS. 9 and 10, the vise 25 is positioned to support the break open shotgun 10 at three points of contact located along the longitudinal length of the shotgun. The forend support 26 contacts the barrels 12 of the shotgun, the grip support 27 contacts the shotgun at the grip G behind the trigger guard 19, and the buttstock support 28 contacts the shotgun near the rear of the buttstock 20. As illustrated by the different positions required to support each firearm 1, 10, the vise 25 has a high-degree of adjustability that allows a wide range of firearms to be supported and secured by the vise.

Figure 12:
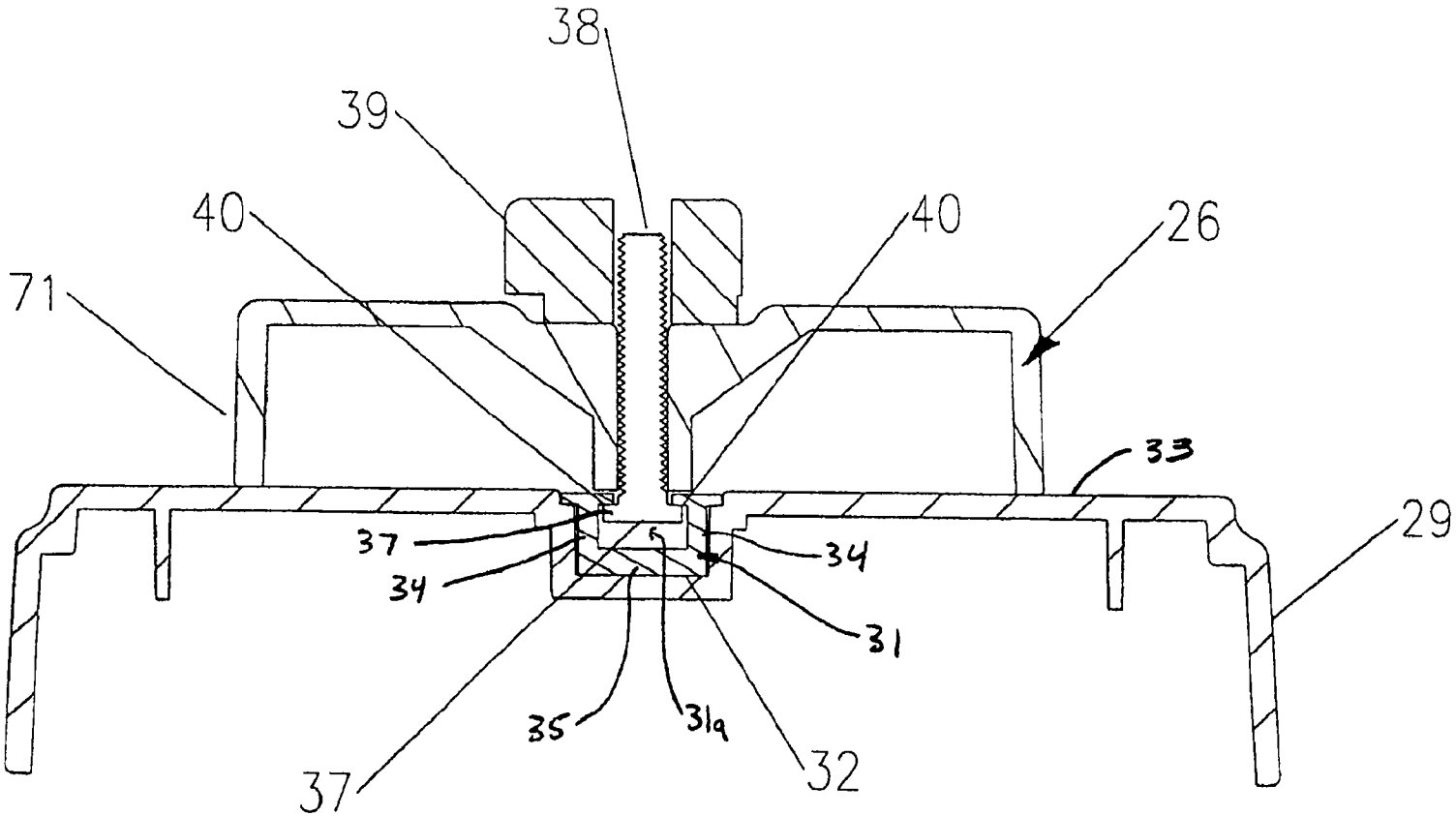
FIG. 12 is a cross-section taken along the plane 12-12 of FIG. 11.
Figure 13:
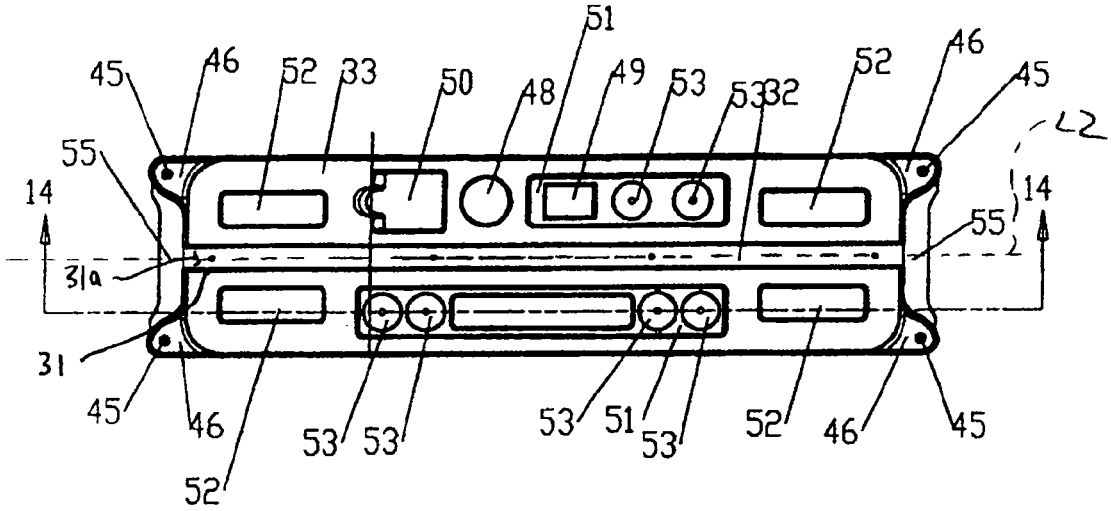
FIG. 13 is a top plan view of a base of the holding device.

The forend support 26, grip support 27, and buttstock support 28 are all removably attached to the base 29 and may be longitudinally translated along the base for optimum positioning for a specific firearm. As shown in FIGS. 12 and 13, the base 29 has a top surface 33 and a recessed channel 32 extending the longitudinal length of the base. The channel 32 receives a retainer, generally indicated 31, that has an elongate opening or slot 31*a* in the top surface of the base. As shown in FIG. 6, the retainer 31 acts as a track along which the forend support 26, the grip support 27, and the buttstock support 28 may be positioned. In the illustrated embodiment, the retainer 31 is a separate part attached to the base 29 but it is understood that the retainer may be formed as an integral part of the base without departing from the scope of this invention.

As shown in FIG. 12, the retainer 31 includes two spaced apart side walls 34 that have a T-shaped cross-sectional shape and a bottom wall 35 connecting the side walls. The retainer opening 31*a* has a bottom portion wider than an upper neck portion between the side walls 34. The opening 31*a* in the retainer 31 may have other shapes without departing from the scope of this invention. As shown in FIG. 12, the bottom cavity of the opening 31*a* is sized to slidably receive a head 37 of a threaded bolt 38 to allow the bolt to slide along the length of the opening. The bolt 38 is restrained from being removed from the retainer 31 by the narrow neck portion of the opening 31*a*. A locking knob 39 removably retains the threaded bolt 38 in the forend support 26. When the locking knob 39 is tightened the bolt 38 translates upward so that the bolt head 37 contacts the lower surface 40 of the upper portion of each side wall 34 that define the neck of the opening 31*a*. The contact of the bolt head with the surfaces 40 of the side walls 34 of the retainer 31 frictionally retains the forend support 26 at a desired longitudinal position on the base 29. This method of retention and positioning the bolt 38 along the retainer 31 is common to the forend support 26, the grip support 27 and the buttstock supports 28. The retainer 31 and opening 31*a* extend the length of the base 29, so that each of the individual supports 26, 27, 28 may be longitudinally positioned along the base or completely removed by sliding the bolt head 37 out of either open end of the retainer.

Figure 14:
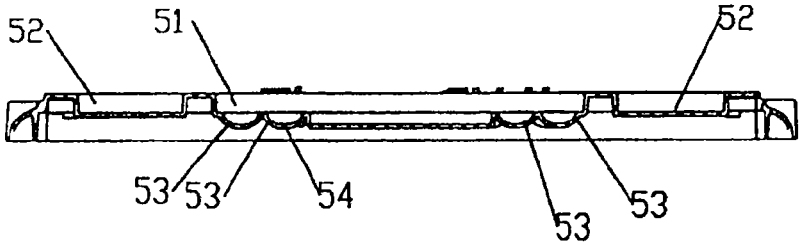
FIG. 14 is a section view taken along the plane 14-14 of FIG. 13.
Figure 15:
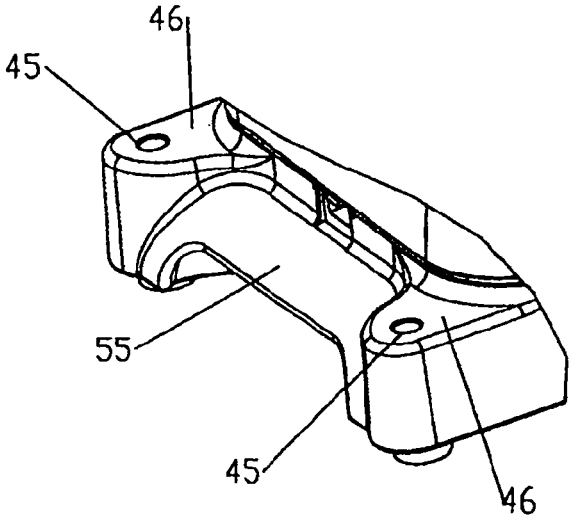
FIG. 15 is a detail fragmentary perspective of one end of the base.
Figure 16:
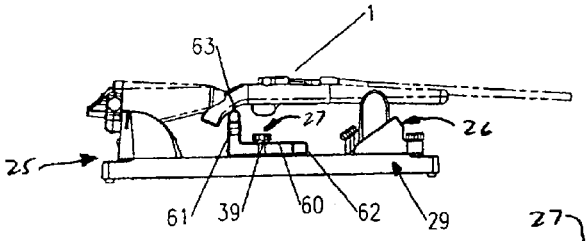
FIG. 16 is side elevation view of a typical bolt-action rifle secured in the holding device.

As shown in FIGS. 13-15, the base 29 is generally rectangular and may be fabricated as a single unit, e.g., by plastic injection molding, so a majority of its features are integral to the part. In one embodiment, the base 29 is about 30 inches in length, about 7 inches wide, and about 1.5 inches tall. The base 29 serves as a platform for mounting the vise 25 to a bench or other suitable work surface. Holes 45 formed in each of the four corners of the base 29 provide clearance for bolts or screws to permanently mount the vise 25 to a work surface. Flat surfaces 46 around the holes 45 provide contact points for a C-clamp, or other user provided clamping device, to temporarily mount the unit to a work surface.

The top surface 33 of the base 29 contains numerous cavities, or depressions, of specific sizes and shapes corresponding to common firearm cleaning supplies and maintenance tools that aid in organization of the work area. For example, round cavities 48 are sized and shaped to receive round solvent bottles (not shown), and rectangular cavities 49 are sized and shaped to receive rectangular bottles and cleaning patches. Two pairs of rectangular storage cavities 52 at the ends of the base 29 are covered with the forend support 26 and buttstock support 27 when the vise 25 is assembled for supporting a firearm. The interior surfaces of the cavities may be stepped to provide additional organizational space by providing multiple layers of storage in a single cavity. As shown in FIG. 14, the base has two elongate rectangular cavities 51 that have hemispherical depressions 53 that provide storage for small parts, such as screws, while longer tools may be stored directly above the depressions in the rectangular cavities. The hemispherical depressions 53 allow for easier small part retrieval than flat-bottomed cavities due to the part naturally resting at the lowest point in the cavity 54. As shown in FIG. 15, a contoured, relieved area on each end of the base 29 between the flat surfaces 46 provides an integral handle 55 to facilitate lifting of the vise 25.

Figure 19:
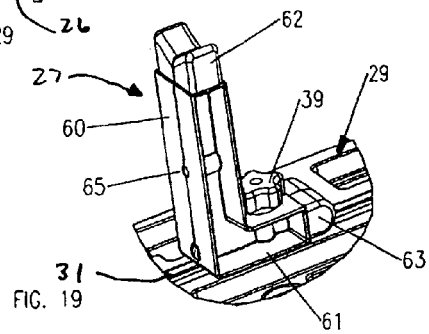
FIG. 19 is a detail view of the grip support at an extended position.

As shown in FIGS. 16-19, the grip support 27 is designed to provide two possible heights for supporting a firearm either in front or behind the trigger guard. The grip support 27 has a generally L-shaped body having two legs 60, 61 oriented 90 degrees relative to one another. In the illustrated embodiment the leg 60 is longer than the leg 61. The grip support 27 is removably mounted to the base 29 with either the longer leg 60 or the shorter leg 61 in the vertical position. As shown in FIG. 19, the longer leg 60 of the grip support 27 has a V-shaped support 62 that will center and secure the underside of the firearm. The V-shaped support 62 is particularly useful for holding firearms, such as break open shotguns 10 (FIG. 18), that require elevation of the firearm mechanism for cleaning or maintenance. The shorter leg 61 has a rounded support face 63 for non-break open rifles and shotguns, such as the bolt-action rifle 1 (see FIG. 16). Both the V-shaped face 62 of the longer leg 60 and the rounded face 63 of the shorter leg 61 are covered with a pliable, rubber-like material to prevent marring the firearm finish and provide a slip resistant contact surface.

Figure 17:
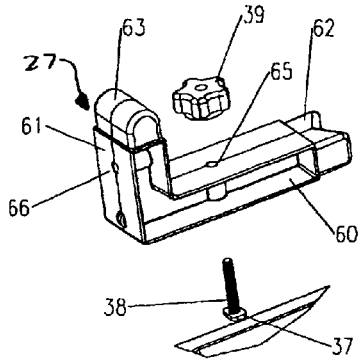
FIG. 17 is an exploded perspective of a grip support of the holding device.
Figure 18:
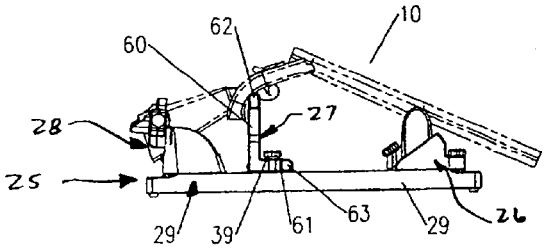
FIG. 18 a side elevation view of a typical break open shotgun secured in the holding device.

The grip support 27 is removably attached to the base 29 via the retainer 31 and can be positioned at any longitudinal point along the base 29. As shown in FIG. 17, the grip support may be attached to the base by a threaded bolt 38 that passes through a hole 65 located in the center of the longer leg 60 of the grip support for attachment of the support with the longer leg in the horizontal position and the shorter leg 61 in the vertical position. The grip support 27 may be attached to the base with shorter leg 61 in the horizontal position and the longer leg 60 in the vertical position (FIG. 18) by the bolt 38 passing through a hole 66 in the shorter leg and the bolt head that is received in the retainer 31. A locking knob 39 is threadably engaged to the bolt 38 and secures the grip support at a desired longitudinal position when tightened. As previously discussed in reference to FIG. 12, tightening the locking knob 39 will translate the bolt head 37 upward pressing the bolt head against the upper portion of the side walls 34 of the retainer 31 to frictionally retain the grip support 27 at the desired longitudinal position.

The grip support 27 is adjusted from its shorter height (FIG. 16) to its taller height (FIG. 18) by removing the threadably engaged locking knob 39 from the threaded bolt 38, lifting the grip support 27 until the free end of the threaded bolt 38 is removed from the hole 65 in the longer leg 61, then repositioning the grip support 27 so the threaded bolt 38 engages the hole 66 in the shorter leg 61. The locking knob 39 is then rethreaded onto the threaded bolt 38 that now protrudes from the shorter leg 21 and is tightened to secure the grip support 27 on the base 29. It is understood that the grip support 27 is adjusted from its taller height to its shorter height in a similar manner.

Figure 20:
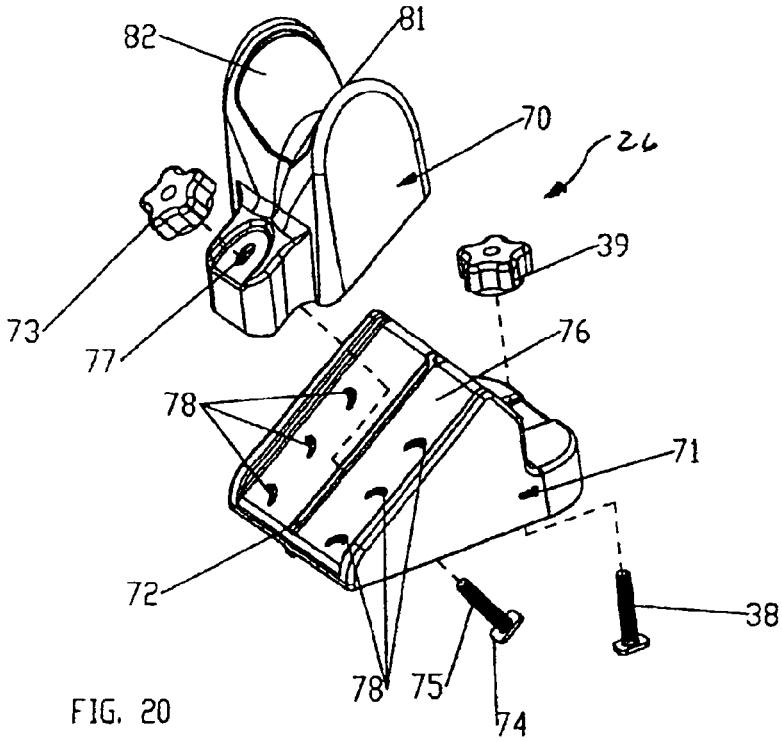
FIG. 20 is an exploded perspective of a forend support of the holding device.
Figure 21:
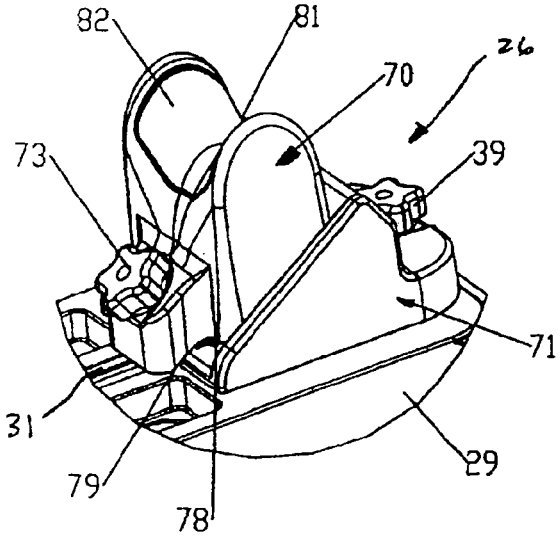
FIG. 21 is a fragmentary detail perspective of the forend support in a lowered position.
Figure 22:
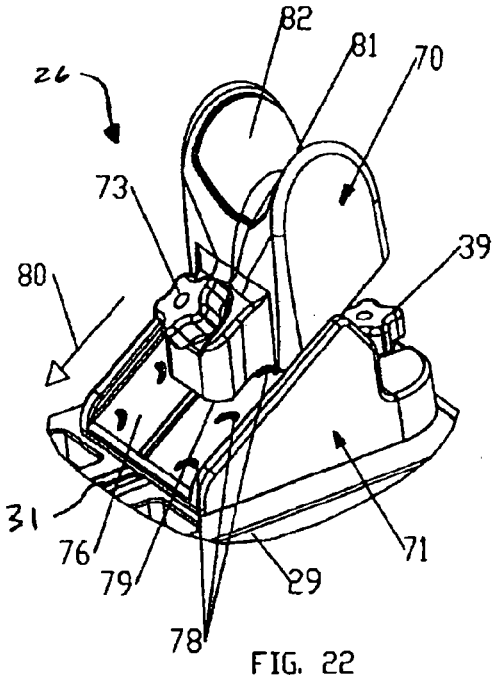
FIG. 22 is a view similar to FIG. 21 but showing the forend support in a raised position.

The forend support 26 is constructed to provide four possible height settings for supporting the forend or barrel of the firearm. As shown in FIG. 20-22, the forend support 26 has a forend upper member, generally indicated 70, releasably engaged to a forend base, generally indicated 71. The forend upper member 70 and forend base 71 are releasably engaged via a locking knob 73 and a threaded bolt 75 having a head 74 that is slidably retained in a slot 72 in the top surface 76 of the forend base 71. The threaded bolt 75 is inserted through a hole 77 in the forend upper member 70 and retained by the threadably engaged locking knob 73. The forend support 26 is adjusted for height by loosening the locking knob 73 and translating the forend upper member 70 along the angled surface or ramp 76 of the forend base 71. Three sets of arcuate protrusions, or elevation stops 78, are formed in the angled surface 76 of the forend base 71. The elevations stops 78 provide three separate elevation positions for the forend upper member 70. As shown in FIGS. 21 and 22, the elevation stops 78 are shaped to engage rounded corners of the forend base 71 to prevent the base from sliding down the top surface 76. During use, the locking knob 73 and elevation stops 78 combine to resist downward translational movement in the direction of arrow 80 (FIG. 22) of the forend upper member 70 relative to the forend base 71. If desired, the user may attach the forend upper 70 directly to the base 29 by inserting the bolt head 74 of the bolt 75 in the retainer 31 in the base rather than the slot 72 of the forend base. This arrangement provides the fourth, and lowest, height setting of the forend support 26. The dual adjusting capability (i.e., longitudinal position and vertical height) of the forend support 26 allows the user maximum flexibility in properly supporting the barrel or forearm of virtually any rifle or shotgun.

The forend base 71 is removably attached to the base 29 via the retainer 31 and can be positioned at any longitudinal point along the base 29. Referring to FIG. 12, the threaded bolt 38 passes through a hole located in the center of the forend base 71 with the head 37 engaged with the retainer 31. The locking knob 39 threadably receives the bolt 38 so that the bolt head 37 is forced upward in the opening 31*a* when the knob is tightened. At the tightened position, the bolt head contacts the lower surfaces 40 of the spaced apart side walls 37 of the retainer 31 so that the forend support 26 is frictionally retained at a desired longitudinal position on the base 29.

The top surface 81 of the forend upper 70 is generally V-shaped to help prevent any side-to-side movement of a barrel of the firearm supported by the firearm vise 25 and to self-center the firearm with the vise. A pliable, resilient (e.g., rubber-like) material 82 covers the top surface 81 of the forend upper 70 to prevent marring the firearm finish and provides a slip resistant contact surface.

The firearm vise 25 of the present invention is designed to completely restrict the movement of a rifle or shotgun for cleaning or maintenance of the firearm. The forend support 26 and grip support 27 provide vertical support and restrict lateral movement of the firearm. The buttstock support 28 provides vertical support for the rear of the firearm and clamps the firearm buttstock to prevent longitudinal movement of the firearm.

Figure 23:
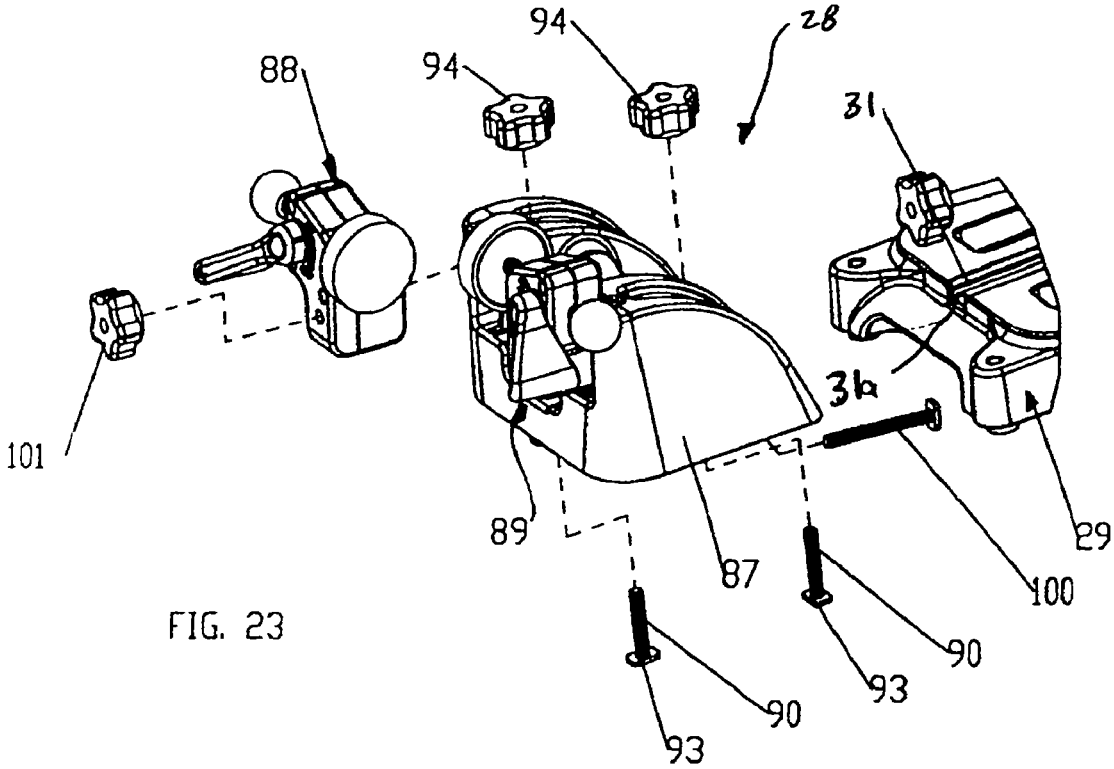
FIG. 23 is an exploded side perspective view of a buttstock support of the holding device.
Figure 24:
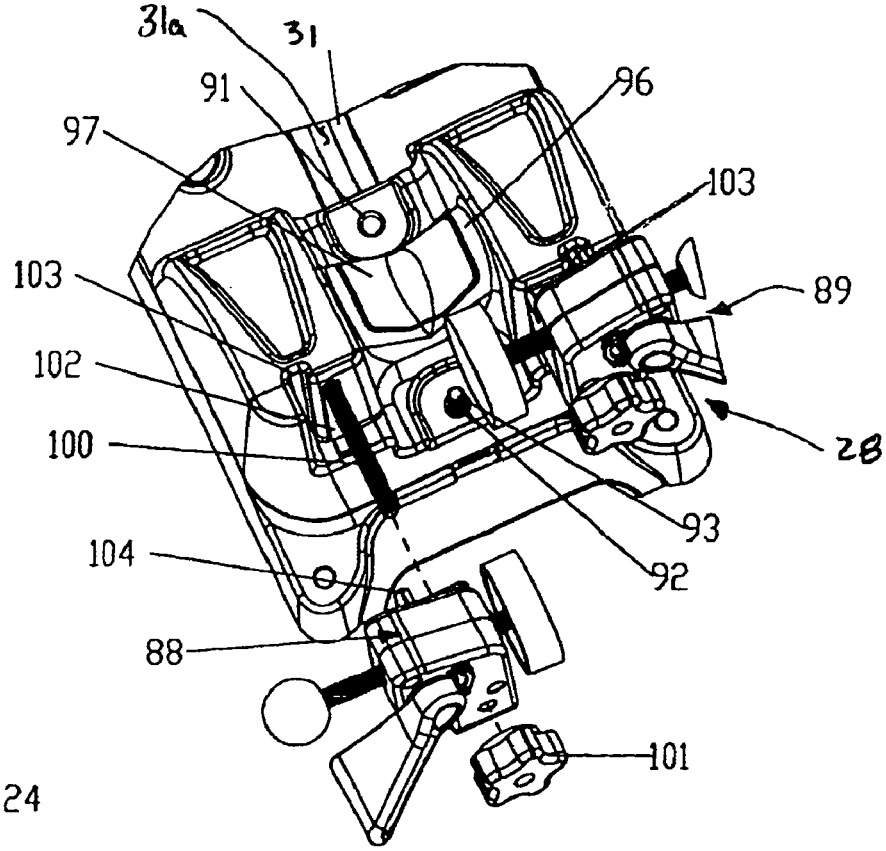
FIG. 24 is an exploded fragmentary top perspective of the buttstock support.

As shown in FIGS. 23 and 24, the buttstock support 28 comprises a buttstock base 87, a left clamp assembly, generally indicated 88, and a right clamp assembly, generally indicated 89. The left clamp assembly 88 and right clamp assembly 89 mirror each other about the longitudinal center of the gun vise 25. The buttstock support 28 is removably attached to the base 29 via the retainer 31 and can be positioned at any point along the longitudinal length of the base 29. The buttstock support 28 is a attached to the base 29 in a similar manner as the forend support 26 and grip support 27. The buttstock support 28 is attached to the base 29 by two threaded bolts 90 that pass through a respective front hole 91 and rear hole 92 located on the longitudinal centerline of the buttstock base 87. Each bolt 90 has a head 93 that is received in the opening 31*a* of the retainer 31. The buttstock support 28 is secured to the bolts 90 by two locking knobs 94 which have been removed from the bolts in FIG. 24 for clarity. Tightening each locking knob 94 will force a respective bolt head 93 upward in the opening 31*a* of the retainer 31 so that each head contacts the lower surface 40 (FIG. 12) of the upper portion of each of the side walls 34 (FIG. 12) that define the neck of the opening so that the buttstock support is secured to the base 29 at the desired longitudinal position.

The top surface 96 of the buttstock base 87 is "V" shaped to help prevent any side-to-side movement of the firearm buttstock and to self-center the firearm in the gun vise 25. A pliable, rubber-like material 97 covers the top surface 96 of the buttstock base 87 to prevent marring the firearm finish and provides a slip resistant contact surface.

Figure 25:
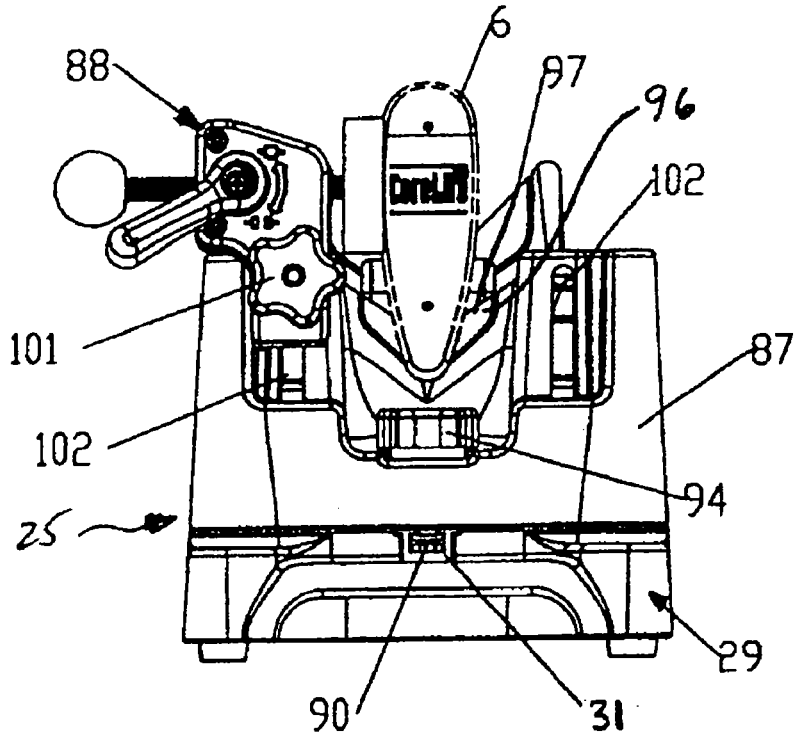
FIG. 25 is a rear elevation view of the invention with a left buttstock clamp in a raised position and a right buttstock clamp removed.
Figure 26:
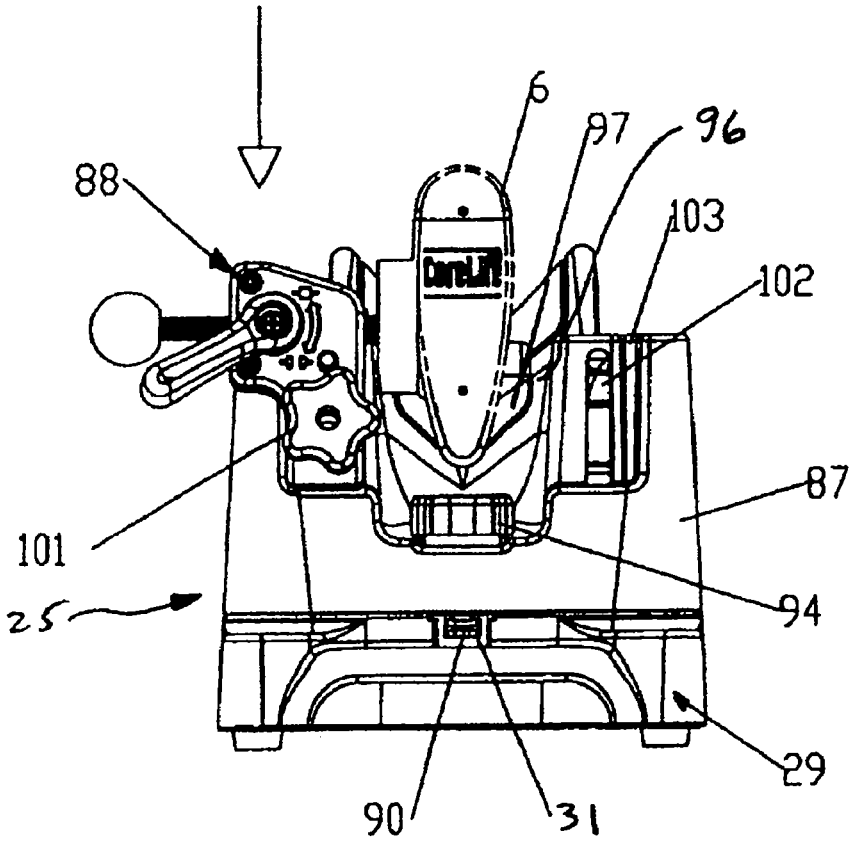
FIG. 26 is a view similar to FIG. 25 but showing the left buttstock clamp in a lowered position.

The clamp assemblies 88, 89 maybe adjusted in the vertical and horizontal (lateral) directions relative to the longitudinal axis L2 of the base 29 to accommodate a wide range of firearm buttstock designs. The two clamp assemblies 88, 89 are independently adjustable for height (vertical location), width of clamping area (horizontal location), and clamping pressure. FIGS. 23 and 24 illustrate one clamp assembly 88 removed from the buttstock base 87, but the other clamp assembly 89 is adjustable on the base in a similar manner as described herein. As shown in FIGS. 23 and 24, each clamp assembly 88, 89 is releasably retained to the buttstock base 87 via a threaded bolt 100 and locking knob 101. The head of each threaded bolt 100 is retained in a respective vertical slot 102 in the rear surface of the buttstock base 87. The threaded bolt 100, and the clamp assembly 88, may translate the length of the slot 102 for vertical adjustment of the clamp assembly 88. Tightening the locking knob 101 frictionally retains the vertical position of the clamp assembly 88 with the buttstock base 87. FIGS. 25 and 26 compare the left clamp at the highest vertical position (FIG. 25) and the lowest vertical position (FIG. 26). An open-ended channel 103 parallel and adjacent to the vertical adjustment slot 102 is designed to accept a mating protrusion 104 (FIG. 24) on the clamp assembly 88. The vertical protrusion 104 is received in the channel 103 to prevent the clamp assembly 88 from rotating on the buttstock base 87 as clamping pressure is applied.

Figure 27:
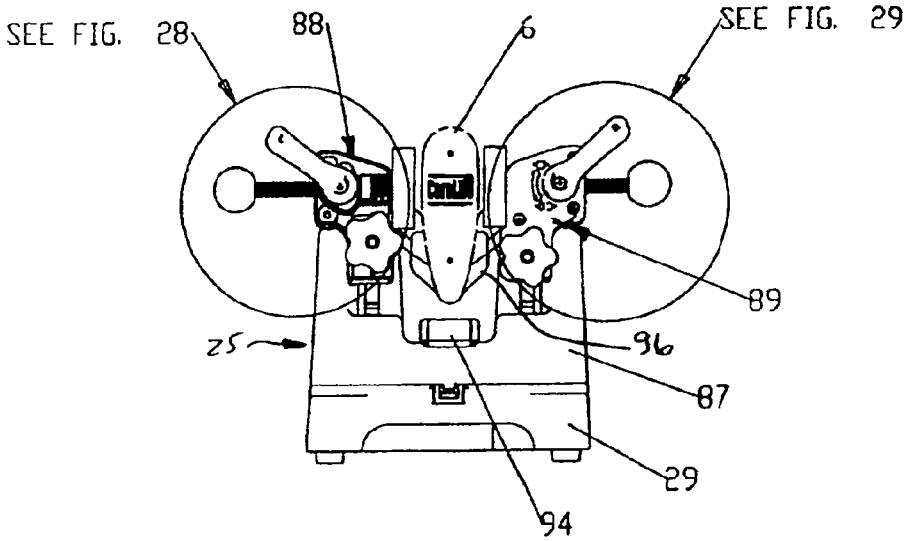
FIG. 27 is a rear elevation view with the buttstock clamps in an open position, the left buttstock clamp being shown with a cover removed.
Figure 28:
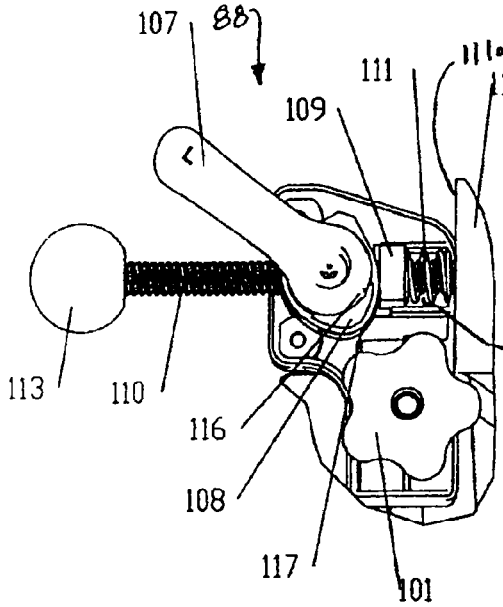
FIG. 28 is a detail view of a portion of FIG. 27.
Figure 29:
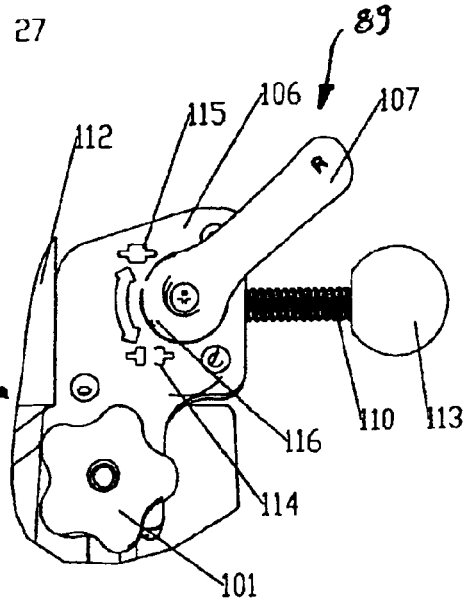
FIG. 29 is a detail view of a portion of FIG. 27.

As shown in FIGS. 28 and 29, each clamp assembly 88, 89 consists of a housing 106 (partially removed in FIG. 28), a clamp lever 107, a cam 108, a threaded cam follower 109 slidably received in a cavity 109*a* of the housing, a threaded adjustor stud 110, a return spring 111 acting at one end against the follower and at its opposite end against a surface 111*a* of the housing, a buttstock pad 112 and an adjustor knob 113. Referring to FIG. 27, a rear view of the gun vise 13 is shown with a rifle buttstock 6 positioned between the two clamp assemblies 88, 89 shown in the open position with the buttstock pads 112 spaced away from the rifle buttstock. As shown in FIG. 29, the housing 106 has an exterior surface that contains a graphical indicator mark 114 for illustrating the open position of the clamp assemblies 88, 89 and a graphical indicator mark 115 illustrating the closed position of the clamp assemblies. The clamp lever 107 has a pointer 116 for pointing to the indicator mark 114, 115 indicating the corresponding open and closed position of the buttstock pads 112.

FIGS. 28 and 31 show the relative positions of the clamp lever 107, camp 108, cam follower 109 and adjustor stud 110 in the open position (FIG. 28) and closed position (FIG. 31) of the left clamp assembly 88. The operation of the right claim assembly 89 is identical to the left clamp assembly 88 described herein. The front half of the housing 106 has been removed in FIGS. 28 and 31 for illustrative purposes. To actuate, or close, the clamp assembly 88, the clamp lever 107 is pushed down to rotate the lever counterclockwise as viewed in FIG. 28. The clamp lever 107 is rotationally connected to the cam 108 that rotates with the lever. The cam 108 has an eccentric surface 117 that contacts the follower 109. When the lever 107 is rotated counterclockwise from the position shown in FIG. 28, the eccentric surface 117 of the cam 108 pushes the cam follower 109 linearly toward the rifle buttstock 6, in the direction of arrow 120 (FIG. 31). The linear movement of the follower 109 compresses the return spring 111. The follower 109 is threadably engaged to the adjustor stud 110 so that linear movement of the follower causes corresponding linear movement of the adjustor stud. The buttstock pad 112 is threadably mounted to the end of the adjustor stud 110 so linear movement of the adjustor stud (and follower 109) causes corresponding linear movement of the buttstock pad 112.

At the closed position of the clamp assemblies 88, 89 illustrated in FIG. 30, the buttstock pads 112 will contact the rifle 1 on each side of the buttstock 6 and exert a clamping force perpendicular to the buttstock for holding the rifle in a secure holding position. As shown in FIG. 32, the pointer 116 of the clamp lever 107 points to the symbol 115 illustrating the closed position of the vise 25. Rotating the clamp lever 107 of the clamp assembly 88 in the clockwise direction as viewed in FIG. 31, causes rotation of the cam 108 such that the follower 109 in contact with the eccentric surface 117 moves away from the buttstock 6 in a direction opposite to the arrow 120. The return spring 111 biases the follower 109 against the eccentric surface 117 so that the follower, adjustor stud 110, and buttstock pad 112 move to the open position when the lever 107 is returned to the position of FIG. 28. It is understood that the lever 107 of the clamp assembly 89 is rotated in an opposite direction (i.e., counterclockwise as viewed in FIG. 29) to move the right buttstock pad 112 to the open position.

The amount of pressure exerted by the clamp assemblies 88, 89 may be adjusted by rotating the adjustor knob 113 clockwise or counterclockwise to adjust the position of the buttstock pad 112 in the closed position of the vise 25. The adjustor knob 113 is attached to one end of the adjustor stud 110, and the buttstock pad is attached at the other end of the adjustor stud. The follower 109 is threadably engaged with the adjuster stud and is slidably received in the cavity 109*a* (FIGS. 28, 31) of the housing so that the follower is rotationally restrained. Therefore, when the adjustor knob 113 and adjustor stud 110 are rotated, the adjustor stud and buttstock pad 112 will traverse linearly as shown by the directional arrows 120, but the follower 109 remains in a fixed position in contact with the eccentric surface 117 of the cam 108.

It is understood that the buttstock pads may comprise foam padding or other compressible material. The pressure exerted by the clamp assemblies 88, 89 on the buttstock 6 is adjustable by turning the adjustment knob 113 so that the gap between the buttstock pads for receiving the buttstock is reduced. The reduced distance between the buttstock pads will cause the pads to compress after contacting the buttstock 6 when the levers 107 of the clamp assemblies 88, 89 are positioned to close the vise 25.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense. For example, the various components of the firearm holding device could have other configurations.

What is claimed is:

1. A firearm supporting device for supporting a firearm with a first portion and a second portion spaced apart from the first portion, the supporting device comprising:

a base having a longitudinal axis, the base being configured to rest on an external surface, the base defines a plane;

a first support coupled to the base and configured to carry the first portion of the firearm, the first support comprises a first section coupled to the base and a second section movably coupled to the first section, the first section having a surface canted relative to the plane and a plurality of interfacing elements on the canted surface, the interfacing elements being positioned to interface with the second section to selectively inhibit movement of the second section relative to the first section, the second section including a support surface positioned to contact the second portion of the firearm;

a second support movably coupled to the base and selectively movable between a first position and a second position spaced apart from the first position along the longitudinal axis, the second support being configured to carry the second portion of the firearm and selectively inhibit movement of the firearm along the longitudinal axis relative to the second support;

the second section is selectively movable relative to the first section between a first position and a second position;

the second section is spaced apart from the base by a first distance and spaced apart from the first section along the longitudinal axis by a second distance when the second section is in the first position;

the second section is spaced apart from the base by a third distance greater than the first distance and spaced apart from the first support along the longitudinal axis by a fourth distance greater than the second distance when the second section is in the second position; and a third support coupled to the base and positioned between the first and second supports, the third support being configured to support at least a portion of the weight of the firearm.

2. A firearm supporting device for supporting a firearm with a first portion and a second portion spaced apart from the first portion, the supporting device comprising:

a base having a longitudinal axis and an upper surface, the base being configured to rest on an external surface;

a first support removably coupled to the base and configured to carry the first portion of the firearm;

a second support movably coupled to the base and projecting from the upper surface, the second support being selectively movable between a first position and a second position spaced apart from the first position along the longitudinal axis, the second support being configured to carry the second portion of the firearm; and a third support removably coupled to the base and positioned between the first and second supports, the third support including a L-shaped member positionable to support the firearm at two different vertical positions.

3. The supporting device of claim 2 wherein the second support is removably coupled to the base.

4. The supporting device of claim 2 wherein the first support is movably coupled to the base and selectively movable along the longitudinal axis.

5. The supporting device of claim 2 wherein the second support comprises first and second clamp assemblies for inhibiting movement of the firearm along the longitudinal axis relative to the second support.

6. The supporting device of claim 2 wherein:

the base further comprises a channel generally parallel to the longitudinal axis;

the first support is movably coupled to the base and positioned to selectively slide along the channel; and the second support is positioned to selectively slide along the channel.

7. The supporting device of claim 2, further comprising a hand-operated retaining mechanism for releaseably attaching the first support to the base.

8. The supporting device of claim 2 wherein at least one of the first or second support is adjustable to provide a plurality of support height for supporting the firearm.

9. A firearm supporting device for supporting a firearm with a first portion and a second portion spaced apart from the first portion, the supporting device comprising:

a base configured to rest on an external surface;

a first support for supporting the first portion of the firearm, the first support being coupled to the base; and a second support for supporting the second portion of the firearm, the second support including a first member coupled to the base, a first clamping assembly movably coupled to the first member, and a second clamping assembly movably coupled to the first member, the first and second clamping assemblies being configured to selectively inhibit movement of the firearm relative to the second support;

wherein at least one of the first support or the second support is removably coupled to the base;

wherein the base is positioned such that the firearm is spaced apart from the base when the firearm is carried by the first and second supports;

wherein the first and second supports project from the base such that the section of the firearm between the first and second supports is completely accessible to an individual when the firearm is carried by the first and second supports; and wherein the first clamping assembly comprises a lever, an eccentric cam coupled to the lever, a cam follower in contact with the cam, and a pad operably coupled to the cam follower and positioned to contact the second portion of the firearm.

10. The supporting device of claim 9 wherein:

the base comprises a longitudinal axis; and at least one of the first or second support is movably coupled to the base and selectively movable along the longitudinal axis.

11. The supporting device of claim 9 wherein:

the first support is removably coupled to the base; and the second support is removably coupled to the base.

12. The supporting device of claim 9 wherein the first and second clamping assemblies are independently adjustable.

13. The supporting device of claim 9 wherein the first clamping assembly is removably attached to the first member and coupleable to the first member at a first position in which the first clamping assembly is spaced apart from the base by a first distance and a second position in which the first clamping assembly is spaced apart from the base by a second distance different than the first distance.

14. The supporting device of claim 9 wherein:

the first support comprises a first section coupled to the base and a second section movably coupled to the first section, the second section including a support surface positioned to contact the first portion of the firearm; and the second section is selectively movable relative to the first section to adjust a distance between the support surface and the base.

15. A firearm supporting device for supporting a firearm with a first section and a second section forward of the first section, the supporting device comprising:

a base having a longitudinal axis;

a first support for carrying the first section of the firearm, the first support being coupled to the base; and a second support for carrying the second section of the firearm, the second support including a first portion coupled to the base and a second portion movably coupled to the first portion, the first portion having a canted surface and a plurality of interfacing elements on the canted surface, the interfacing elements being positioned to interface with the second portion to selectively inhibit movement of the second portion relative to the first portion, the second portion including a support surface positioned to contact the second section of the firearm, wherein the second portion is selectively movable relative to the first portion between a first position and a second position, wherein the second portion is spaced apart from the base by a first distance and spaced apart from the first support along the longitudinal axis by a second distance when the second portion is in the first position, and wherein the second portion is spaced apart from the base by a third distance greater than the first distance and spaced apart from the first support along the longitudinal axis by a fourth distance greater than the second distance when the second portion is in the second position.

16. The supporting device of claim 15 wherein the first support comprises a clamping assembly for securing the firearm to the first support.

17. The supporting device of claim 15 wherein the first support is configured to selectively inhibit movement of the firearm along the longitudinal axis relative to the first support.

18. The supporting device of claim 15 wherein the base comprises a plurality of cavities sized to hold at least one of a firearm cleaning supply or a firearm cleaning tool.

19. The supporting device of claim 15 wherein at least one of the first or second support is removably coupled to the base.

20. The supporting device of claim 15 wherein at least one of the first or second support is movably coupled to the base and selectively movable along the longitudinal axis between a first position and a second position spaced apart from the first position.

* * * * *

UNITED STATES PATENT AND TRADEMARK OFFICE

CERTIFICATE OF CORRECTION

PATENT NO. : 7,584,690 B2
APPLICATION NO. : 11/271100
DATED : September 8, 2009
INVENTOR(S) : Dennis Cauley It is certified that error appears in the above-identified patent and that said Letters Patent is hereby corrected as shown below:

In column 3, line 34, delete "PERFERRED" and insert -- PREFERRED --, therefor.

In column 7, line 58, delete "maybe" and insert -- may be --, therefor.

In column 8, line 36, delete "camp 108" and insert -- cam 108 --, therefor.

In column 10, line 57, in claim 7, delete "releaseably" and insert -- releasably --, therefor.

Signed and Sealed this

Twenty-second Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,584,690 B2
APPLICATION NO. : 11/271100
DATED : September 8, 2009
INVENTOR(S) : Dennis Cauley It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 530 days.

Signed and Sealed this

Fourteenth Day of December, 2010

David J. Kappos

David J. Kappos
*Director of the United States Patent and Trademark Office*